US006016650A

United States Patent [19]

Legrom

[11] Patent Number: 6,016,650

[45] Date of Patent: Jan. 25, 2000

[54] FIBER FEED ELEMENT FOR A ROTOR SPINNING MACHINE

[76] Inventor: Friedrich Legrom, Hauenstrasse 6, D-71540 Murrhardt, Germany

[21] Appl. No.: 09/157,243

[22] Filed: Sep. 18, 1998

[30] Foreign Application Priority Data

Sep. 26, 1997 [DE] Germany ..... 197 42 498

[51] Int. Cl.[7] ..... D01H 4/00

[52] U.S. Cl. ..... 57/413; 57/352; 57/404; 57/408; 57/411

[58] Field of Search ..... 57/352, 404, 406, 57/407, 408, 411, 413, 417

[56] References Cited

U.S. PATENT DOCUMENTS

| | | | |
|---|---|---|---|
| 4,098,065 | 7/1978 | Stahlecker et al. | 57/301 |
| 5,111,651 | 5/1992 | Pohn et al. | 57/411 |
| 5,423,172 | 6/1995 | Furtmeier et al. | 57/407 |
| 5,555,717 | 9/1996 | Schuller et al. | 57/406 |
| 5,685,137 | 11/1997 | Raasch | 57/407 |
| 5,794,430 | 8/1998 | Grecksch et al. | 57/417 |

FOREIGN PATENT DOCUMENTS

| | | |
|---|---|---|
| 19544617 | 6/1997 | Germany . |
| 19603730 | 8/1997 | Germany . |

OTHER PUBLICATIONS

Company brochure "Ersatzteile für Textilmachinen" (Spare Parts for Textile Machinery) by the company LEGROM, published 1997.

*Primary Examiner*—William Stryjewski
*Attorney, Agent, or Firm*—Paul Vincent

[57] ABSTRACT

The invention concerns a fiber feed element 1 of a rotor spinning machine. A bearing surface formed on the lower side 2 of the fiber feed element 1 can be disposed above a opening cylinder for the processing of the initial fiber material. A pivotably borne fiber channel plate can be supported on an upper side 5 of the fiber feed element 1. A fiber guide channel 4 is fashioned into the fiber feed element 1 and extends from the bearing surface up to the support surface. The fiber feed element 1 is made from fiber-glass-reinforced plastic with a fraction of 30 to 60% glass fibers. Use of a composite material allows the conventional fiber feed element to be more simply constructed and produced.

10 Claims, 3 Drawing Sheets

FIBER FEED ELEMENT FOR A ROTOR SPINNING MACHINE

This application claims Paris Convention priority of German patent application number 197 42 498.8 filed Sep. 26, 1997, the complete disclosure of which is hereby incorporated by reference.

BACKGROUND OF THE INVENTION

The present invention concerns a fiber feed element of a rotor spinning machine the lower bearing surface of which is disposed above an opening cylinder for processing the initial fiber material and the support surface of which, on its upper side, can support a pivotably borne fiber channel plate and having a fiber guide channel fashioned in the fiber feed element which extends from the bearing surface up to the support surface.

A fiber feed element of this kind has e.g. become known in the art through the brochure "Replacement Parts for Textile Machines" from the company Legrom published in 1997.

This fiber feed element is installed into a so-called spin box of a rotor spinning machine. The processing of the initial fiber material into completed yarn takes place in the spin box, i.e. the actual spinning process. In addition to the fiber feed element upon which the invention is based, other components are also accommodated within the spin box. Rotation of an opening cylinder reduces the size of the initial fiber material and introduces it into a fiber guide channel of the fiber feed element. The fiber guide channel maps into a fiber channel plate so that the processed initial fiber material is passed to a withdrawal nozzle and a yarn withdrawal tube. During spinning, a rotor housing closes off the fiber channel plate. The withdrawal nozzle is positioned towards and aligned with a rotor which accepts the yarn.

The conventional fiber feed element is made from a metal blank. The metal blank must subsequently be coated to give the fiber guide channel fashioned in the metal blank a good quality surface facilitating low-friction transport of the fiber material. Additional post-processing of the surface by polishing or other treatment processes is, however, normally required.

A sealing ring must be glued in the vicinity of the transition between the fiber guide channel of the fiber feed element and the fiber channel plate. The pivoting support of the fiber channel plate on the fiber feed element is effected via a separate fiber feed element, namely a runner, disposed on the fiber feed element. The conventional fiber feed element therefore has a plurality of components.

It is therefore the underlying technical problem associated with the invention to simplify the construction and manufacture of the fiber feed element.

SUMMARY OF THE INVENTION

This technical problem is solved in accordance with the invention in that the fiber feed element is made from a fiber-glass-reinforced plastic having a fraction of 30 to 60% glass fibers.

The fiber feed element consists essentially of a composition material and can be preferentially produced in an extrusion process. It does not have an isotropic surface rather a layered structure so that the fiber feed element is extremely stable.

At the same time, the extruded fiber feed element has an excellent surface to which fiber materials cannot adhere.

In a preferred embodiment, the fiber feed element is made from fiber-glass-reinforced polyacrylamide. Instead of fiber-glass-reinforcement it is also possible for metallic or ceramic materials to be imbedded into a base material made from polyacrylamide. The fiber feed element made from this material also has, in addition to the above mentioned properties, a very low thermal expansion coefficient and, despite the high amount of fiber content, a very good surface.

If the fiber feed element is made from a single piece with the runner formed on the fiber feed element a structure comprising a plurality of fiber feed element components is avoided. The runner needed for the pivotable support of the fiber channel plate is already formed on the fiber feed element following extrusion and with the required amount of strength and low-friction characteristics.

In another embodiment, means are provided on the support surface of the fiber feed element for the detachable mounting of a seal for sealing between the fiber guide channel and the continuation of the fiber guide channel into the fiber channel plate. The sealing element can be exchanged even when the fiber feed element is mounted within the rotor spinning machine.

In an improvement of this embodiment, a ring groove is fashioned into the fiber feed element the sides of which have latching nubs for engagement with the seal. A sealing ring (O-ring) can be easily introduced into the ring groove and snaps therein. The sealing ring can easily be removed from the ring groove with the assistance of a tool. This process can also be carried out when the fiber feed element is installed in the rotor spinning machine. It is not necessary that the fiber feed element be removed in order to change the seal.

In an additional variation, a sealing enlargement is formed in the border region of the bearing surface which extends transverse to the travel direction of the opening cylinder. The sealing enlargement obviates the need for an additional sealing element in the transitional region between the fiber feed element and an adjacent component for covering the opening cylinder.

In order to protect and strengthen particularly heavily loaded surfaces of the fiber feed element, a coating can be applied to the bearing surfaces and/or the fiber guide channel.

It is likewise preferred to fashion devices into one side of the fiber feed element which permit an alignment of the separation between the bearing surface and the opening cylinder. Suitable means, e.g. appropriate slotted holes, allow the fiber feed element to be mounted and positioned above the opening cylinder.

The strength of the fiber feed element can be improved to a further extent when the fiber feed element has a channel jacket (core) made from a ceramic or metallic material which surrounds the fiber guide channel. The channel jacket increases the stability of the arrangement.

Additional features and advantages of the invention can be derived from the following description of an embodiment of the invention with reference to the drawing, showing details important to the invention, and from the claims. The separate features can be incorporated individually or collectively in the invention in arbitrary combination for certain embodiments thereof.

DESCRIPTION OF THE PREFERRED EMBODIMENT

The invention is shown schematically in the figures so that the essential features of the invention can be easily recognized. The illustrations are not necessarily to be taken to scale.

Figure 1:
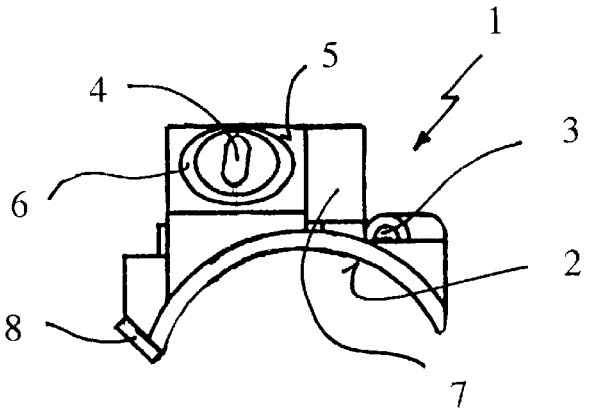
FIG. 1 shows a front view of the fiber feed element in accordance with the invention.

FIG. 1 shows a fiber feed element 1 of a rotor spinning machine. The fiber feed element 1 can have its curved lower side 2 disposed above a opening cylinder of the rotor spinning machine. The opening cylinder serves for processing the initial fiber material and is not shown in the figure. The fiber feed element 1 can be securely mounted within a spin box of the rotor spinning machine using one of a plurality of threaded holes 3. A fiber guide channel 4 is formed within the fiber feed element 1. The fiber guide channel 4 extends from an upper side 5 of the fiber feed element 1 down to its lower side 2.

Fiber material removed from the opening cylinder can be guided by the fiber guide channel 4 through the fiber feed element 1. The upper side 5 of the fiber feed element 1 serves as a supporting surface for a fiber channel plate (not shown in the figure) into which the fiber guide channel is extended. A ring groove 6 is fashioned into the upper side 5 to seal the transition region between the fiber feed element 1 and the fiber channel plate. The ring groove 6 has latching nubs on its side walls to engage a seal placed therein. The elastic seal can therefore be pushed into the ring groove 6 and adequately held at this location. An installed seal can be easily removed with the assistance of a tool.

The fiber channel plate is borne in a pivotable fashion on the fiber feed element 1. The fiber channel plate can be folded away from the upper side 5 to open the fiber guide channel 4 and for inserting the seal into the ring groove 6. When pivoting the fiber channel plate, one part of the fiber channel plate is moved in cooperation with a fiber feed element runner 7. The runner 7 is integral with the fiber feed element 1 and forms, together therewith, a single-piece. A sealing enlargement 8 facilitates a sealed seating of an additional adjacent component of the rotor spinning machine.

Figure 2:
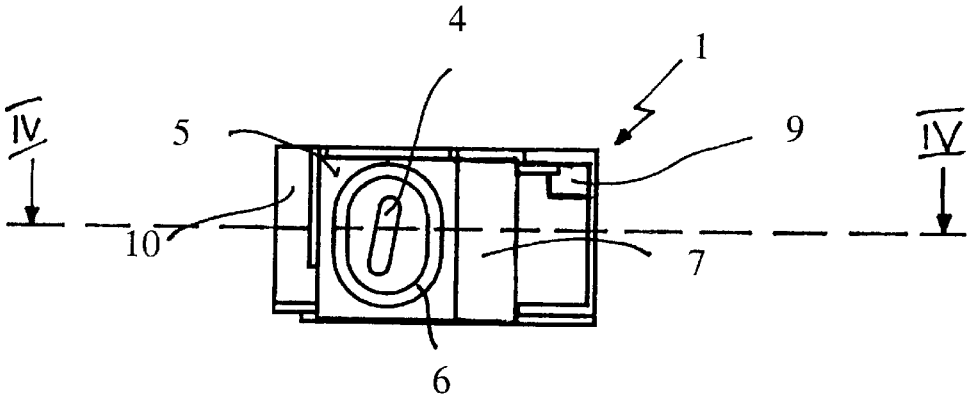
FIG. 2 shows a plan view on the fiber feed element of FIG. 1.

A plan view of the fiber feed element 1 is shown in FIG. 2. The fiber guide channel 4 extends from the lower side of the fiber feed element 1 up to the upper side 5. The ring groove 6 is fashioned into the fiber feed element 1 at its upper side 5 and surrounds the fiber guide channel 4. A sealing element can be inserted into the ring groove 6 to seal the transition of the fiber guide channel 4 into the fiber channel plate placed on the upper side 5 of the fiber feed element 1. The fiber channel plate is borne in a pivotable fashion and one section thereof is supported and guided by the runner 7. Shoulders 9 and 10 have internal threaded holes so that the fiber feed element 1 can be bolted within the spin box of the rotor spinning machine.

Figure 3:
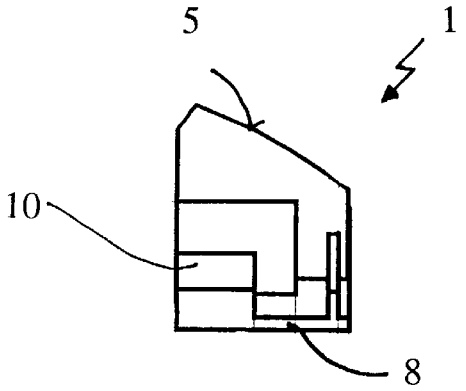
FIG. 3 shows a side view of the fiber feed element of FIG. 1.

The fiber feed element 1 has a sideward shoulder 10 in accordance with FIG. 3 having a threaded hole in its internal portion for attachment of the fiber feed element 1. A fiber channel plate can seat on the upper side 5 of the fiber feed element 1. The seal 8 facilitates the sealed seating of an additional spin box component of the rotor spinning machine.

Figure 4:
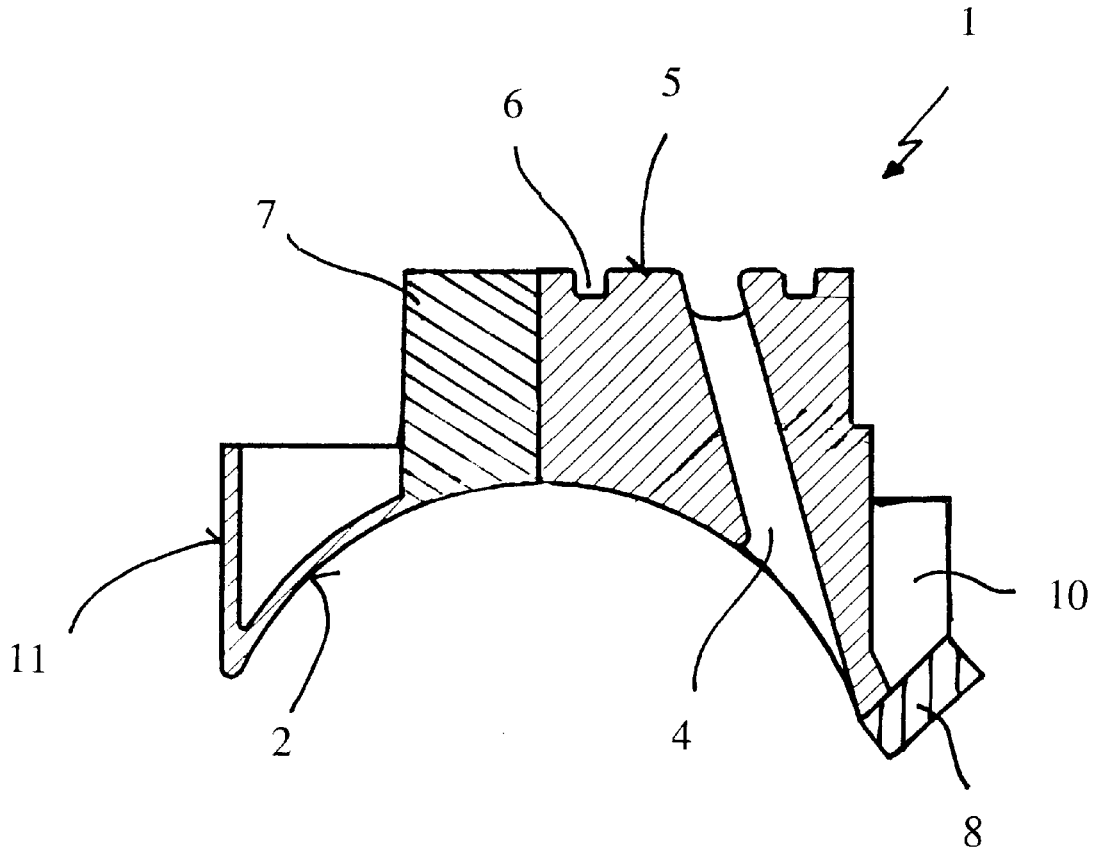
FIG. 4 shows a cut along the cut line IV—IV of FIG. 2.

The cut representation of FIG. 4 shows the fiber guide channel 4 fashioned within the fiber feed element. The fiber guide channel 4 extends continuously through from the lower side 2 up to the upper side 5 of the fiber feed element 1. After fiber material processing by the opening cylinder below lower side 2, individual fibers can be transported through the fiber guide channel 4. A ring groove 6 surrounds the fiber guide channel 4 at the upper side 5 into which a sealing ring can be snapped. A threaded hole is fashioned into the shoulder 10 to attach the fiber feed element 1. A sealing enlargement 8 facilitates the sealing seating of an additional spin box component of the rotor spinning machine onto the fiber feed element 1. The fiber feed element 1 has an integral runner 7 extruded with the fiber feed element 1. A part of the fiber channel plate can guide along the runner 7 when the fiber channel plate is pivoted towards or away from the upper side 5. Stop means are provided for on the side surfaces 11 for additional elements of the spin box.

Figure 5:
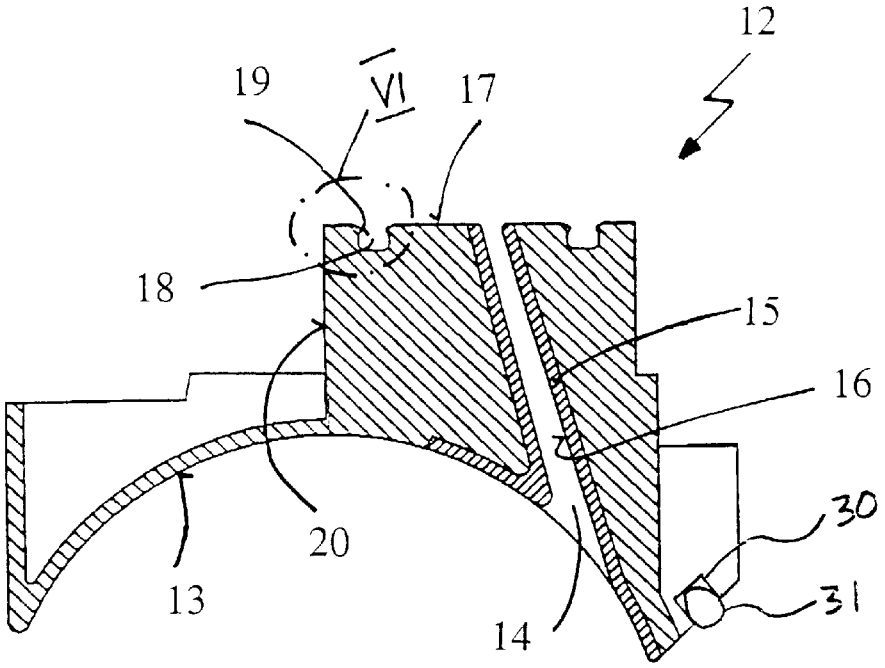
FIG. 5 shows a cut analogous to FIG. 4 through another fiber feed element in accordance with the invention.

A fiber feed element 12 in accordance with FIG. 5 corresponds to the fiber feed element 1. It can be disposed with its lower side 13 above an opening cylinder of a spin box. A channel jacket 15 is inserted into a fiber guide channel 14. The channel jacket 15 is of high strength and has as smooth a surface 16 as possible so that fiber material can easily glide from the opening cylinder into the fiber guide channel 14. The channel jacket 15 is adapted to the geometry of the fiber guide channel 14 and attached to the fiber guide channel 14 in a detachable manner. In this manner, channel jackets 15 having differing inlet and outlet cross-sections can be inserted into the fiber guide channel 14. A defective channel jacket 15 is easy to exchange if, for example, the quality of the channel surface 16 has become deteriorated during operation of the rotor spinning machine. Un upper side 17 of the fiber feed element 12 supports a spin box channel plate. A ring groove 18 is fashioned into the upper side 17 for the acceptance of the sealing element. The sealing element can be snapped in the ring groove 18 via latching nubs 19 fashioned onto the sides of the ring groove 18. A runner for guiding the fiber channel plate is a separate component of the fiber feed element 12 and can be screwed, plugged and/or snapped to a side surface 20.

Figure 6:
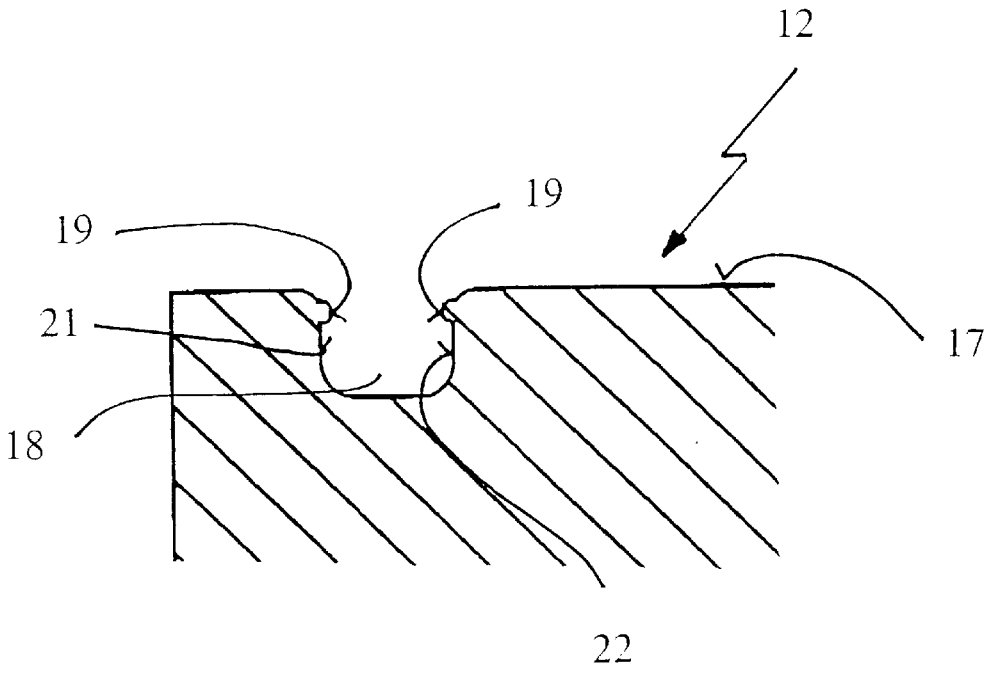
FIG. 6 shows an enlargement of a partial region of the fiber feed element according to FIG. 5.

FIG. 6 shows the latching nubs 19 in an enlarged view of a detail according to FIG. 5. The fiber feed element 12 has the ring groove 18 on its upper side 17 the sides 21 and 22 of which have latching nubs 19. An inserted sealing element can be engaged by the latching nubs and fixed in place.

The fiber feed elements 1 and 12 shown in FIGS. 1 through 6 are extruded as an integral piece from fiber-glass-reinforced polyarylamide. The fiber feed elements 1 and 12 thereby have very high strength and retain their shape in the spin box even under high load. In particular, the lower sides 2 or 13 and the fiber guide channel 4 and 14 are of very good surface quality even directly following extrusion. This facilitates good transport of the fiber material so that post-processing of the manufactured fiber feed element 1 and 12 is not necessary. An improvement in the fiber transport can, however, be effected by additionally coating the lower sides 2 or 13 and the inner surfaces of the fiber guide channel 4.

The invention concerns a fiber feed element 1 of a rotor spinning machine. A bearing surface formed on the lower side 2 of the fiber feed element 1 can be disposed above a opening cylinder for the processing of initial fiber material. A pivotably borne fiber channel plate can be supported on an upper side 5 of the fiber feed element 1. A fiber guide channel 4 is fashioned into the fiber feed element 1 and extends from the bearing surface up to the support surface. The fiber feed element 1 is made from fiber-glass-reinforced plastic with a fraction of 30 to 60% glass fibers. Use of a composite material simplifies construction and manufacture of the conventional fiber feed element.

As shown in FIG. 5, a sealing member 31 seating in an appropriate groove 30 in the lower right portion of the fiber feed element 12 facilitates the sealed seating of an additional spin box component of the rotor spinning machine onto the fiber feed element 12.

I claim:

1. A fiber feed element supporting a fiber channel plate and communicating with an opening cylinder processing an initial fiber material in a rotor spinning machine, the fiber feed element comprising:

a body;

a bearing surface on a lower side of said body and to be disposed above the opening cylinder;

a support surface on an upper side of said body, said support surface for pivotable support of the fiber channel plate, wherein said body encloses a fiber guide channel extending from said bearing surface up to said support surface, and wherein said body consists essentially of fiber glass reinforced plastic having a fraction of 30% to 60% glass fibers.

2. The fiber feed element of claim 1, wherein said plastic is polyacrylamide.

3. The fiber feed element of claim 1, further comprising a runner integral with said body.

4. The fiber feed element of claim 1, wherein said support surface comprises means for removable attachment of a seal for sealing between said fiber guide channel and a continuation of said fiber guide channel in the fiber channel plate.

5. The fiber feed element of claim 4, wherein said sealing means have a ring groove fashioned into said body, said groove having sides comprising latching nubs for engaging the seal.

6. The fiber feed element of claim 1, further comprising a sealing enlargement disposed in an edge region of said bearing surface and extending transverse to a direction of travel of the opening cylinder.

7. The fiber feed element of claim 1, further comprising a channel jacket made from one of a ceramic and a metallic material, said channel jacket defining said fiber guide channel.

8. The fiber feed element of claim 7, further comprising a coating on at least one of said bearing surface and said channel jacket.

9. The fiber feed element of claim 1, further comprising a coating on at least one of said bearing surface and said fiber guide channel.

10. The fiber feed element of claim 1, further comprising devices fashioned into the fiber feed element to align a separation between said bearing surface and the opening cylinder.

* * * * *